US007506440B2

(12) United States Patent
Bruce

(10) Patent No.: US 7,506,440 B2
(45) Date of Patent: Mar. 24, 2009

(54) TITANIUM TREATMENT TO MINIMIZE FRETTING

(75) Inventor: Robert William Bruce, Loveland, OH (US)

(73) Assignee: General Electric Company, Schenectady, NY (US)

( * ) Notice: Subject to any disclaimer, the term of this patent is extended or adjusted under 35 U.S.C. 154(b) by 253 days.

(21) Appl. No.: 11/247,686

(22) Filed: Oct. 11, 2005

(65) Prior Publication Data

US 2009/0007542 A1 Jan. 8, 2009

Related U.S. Application Data

(60) Provisional application No. 60/694,759, filed on Jun. 28, 2005.

(51) Int. Cl.

| | |
|---|---|
| ***B05D 3/12*** | (2006.01) |
| ***B21D 19/00*** | (2006.01) |
| ***B21D 53/78*** | (2006.01) |
| ***B21K 25/00*** | (2006.01) |
| ***B63H 1/26*** | (2006.01) |
| ***C22C 14/00*** | (2006.01) |
| ***C23C 8/00*** | (2006.01) |
| ***C23C 16/00*** | (2006.01) |
| ***C23C 22/00*** | (2006.01) |

(52) U.S. Cl. ..... 29/889.2; 29/889.7; 29/889.71; 29/889.72; 29/402.18; 427/249.1; 427/249.17; 427/249.19; 427/357; 427/533; 148/206; 148/207; 148/212; 148/237; 148/246; 148/421; 416/241 R

(58) Field of Classification Search ..... 29/889.2, 29/889.21, 889, 889.7–889.72, 402.13, 402.16, 29/402.18; 427/248.1, 249.1, 249.17, 249.19, 427/355, 357, 533; 148/206, 207, 210, 212, 148/237, 246, 407, 421; 416/241 R, 241 B, 416/219 R See application file for complete search history.

(56) References Cited

U.S. PATENT DOCUMENTS

| | | | | |
|---|---|---|---|---|
| 3,628,921 | A | | 12/1971 | Hill |
| 3,793,195 | A | * | 2/1974 | Betts ..... 428/469 |
| 4,704,336 | A | | 11/1987 | Spriggs |
| 4,943,485 | A | | 7/1990 | Allam et al. |
| 5,074,970 | A | | 12/1991 | Routsis et al. |

(Continued)

FOREIGN PATENT DOCUMENTS

| | | |
|---|---|---|
| DE | 0 282 831 A1 | 3/1988 |

(Continued)

*Primary Examiner*—David P Bryant
*Assistant Examiner*—Alexander P Taousakis
(74) *Attorney, Agent, or Firm*—McNees Wallace & Nurick LLC

(57) ABSTRACT

A method for surface treating a titanium gas turbine engine component. The method includes providing a gas turbine engine component having a titanium-containing surface. The component is heated to a temperature sufficient to diffuse carbon into the titanium and below 1000° F. The surface is contacted with a carbon-containing gas to diffuse carbon into the surface to form carbides. Thereafter, the carbide-containing surface is coated with a lubricant comprising a binder and a friction modifier. The binder preferably including titanium oxide and the friction modifier preferably including tungsten disulfide. The coefficient of friction between the surface and another titanium-containing surface is less than about 0.6 in high altitude atmospheres.

9 Claims, 6 Drawing Sheets

U.S. PATENT DOCUMENTS

| | | | | | |
|---|---|---|---|---|---|
| 5,308,707 | A | * | 5/1994 | Cellier et al. | 428/610 |
| 5,315,822 | A | | 5/1994 | Edwards, III | |
| 5,356,545 | A | * | 10/1994 | Wayte | 508/138 |
| 5,573,604 | A | | 11/1996 | Gerdes | |
| 5,601,933 | A | * | 2/1997 | Hajmrle et al. | 428/660 |
| 5,797,239 | A | | 8/1998 | Zaccone et al. | |
| 5,891,267 | A | | 4/1999 | Schaeffer et al. | |
| 5,910,376 | A | | 6/1999 | Kelly | |
| 6,190,133 | B1 | | 2/2001 | Ress, Jr. et al. | |
| 6,447,924 | B1 | | 9/2002 | Bettridge | |
| 2002/0108682 | A1 | | 8/2002 | Li et al. | |
| 2004/0223850 | A1 | | 11/2004 | Kramer et al. | |

FOREIGN PATENT DOCUMENTS

| | | | |
|---|---|---|---|
| EP | 1 380 657 | A1 | 1/2004 |
| EP | 1 422 307 | A1 | 5/2004 |
| GB | 2053744 | A | 2/1981 |
| JP | 07090541 | A | 4/1995 |
| JP | 08260127 | A | 10/1996 |
| JP | 09323191 | A | 12/1997 |
| JP | 2002371348 | A | 12/2002 |
| JP | 2003041359 | A | 2/2003 |

* cited by examiner

TITANIUM TREATMENT TO MINIMIZE FRETTING

FIELD OF THE INVENTION

The present invention is directed to a method for surface treating titanium and titanium alloys. In particular, the invention is drawn to surface treating gas turbine engine components.

BACKGROUND OF THE INVENTION

A gas turbine engine generally operates by pressurizing air in a compressor and mixing the air with fuel in a combustor. The air/fuel mixture is ignited and hot combustion gasses result, which flow downstream through a turbine section. The compressor typically includes compressor disks having airfoils dovetailed into the compressor disk. The compressor may include multiple disks, each having a plurality of airfoils.

Each of the compressor disk and the airfoils typically contain titanium, usually in the form of a titanium alloy. The titanium-to-titanium surface contact is susceptible to fretting wear and fretting fatigue. Fretting is the degradation of the surface usually resulting from localized adhesion between the contacting surfaces as the surfaces slide against each other. The problem of fretting is magnified in systems having a titanium-containing surface contacting another titanium-containing surface. For example, in a titanium compressor disk and titanium airfoil system, the fretting fatigue may result from movement of the dovetail of the airfoil within the slot in the compressor disk. As the disk rotates at a higher rotational speed, the centrifugal force on the airfoil urges the blade to move outward and slip along the surface of the dovetail. As the disk rotates at a lower rotational speed, the centrifugal force on the airfoil is less and the airfoil may slip inward toward the compressor disk. A second source of movement resulting in fretting fatigue in the dovetail system is the vibration from the airfoil. Aerodynamic forces may result in oscillation of the airfoil within the dovetail slot. The oscillation translates to high frequency vibration through the airfoil to the dovetail portion of the airfoil. As the airfoil vibrates, the surface of the dovetail section of the airfoil slides against the surface of the slot of the compressor disk, resulting in fretting fatigue.

In an attempt to solve the fretting wear and fatigue problem, the titanium dovetail surface of the airfoil may be shot-peened to create compressive stress in the airfoil surface. The increased compressive stress on the surface results in increased hardness, which reduces the adhesion between surfaces thereby reducing the fretting fatigue and wear. However, the shot-peening process requires expensive equipment additional processing steps and may result in surfaces having variability in roughness and dimensional accuracy. In addition, the shot-peened surface provides insufficient resistance to fretting fatigue and wear.

In another attempt to solve the fretting wear and fatigue problem, a coating of CuNiIn, aluminum bronze or a $MoS_2$ lubricant may be coated onto the airfoil's dovetail surface to provide a surface that experiences less adhesion between surfaces. The application of lubricants such as $MoS_2$ provides some protection from localized adhesion initially, but lubricants and lubricant coating wear away or deteriorate under service conditions for a gas turbine engine. The reduced adhesion acts to reduce fretting fatigue and wear, but does not provide reduced adhesion throughout the operational conditions of the compressor disk/airfoil system. The conventional lubricant coatings also eventually lead to material transfer between the surfaces. In addition, the coated dovetail surface provides insufficient resistance to fretting fatigue and wear.

Carburizing is a method that has been used to increase hardness of a surface. It is a well-known method for hardening steel surface to improve wear properties. Known carburizing methods take place at high temperatures, including temperatures of greater than about 1700° F. (927° C.). High temperature carburization methods suffer from the drawback that the method requires expensive, specialized equipment, capable of operating under high temperatures. Thermal treatments of blade dovetails and disks preclude use of conventional carburizing practices.

What is needed is an inexpensive, low-temperature titanium treatment that reduces fretting fatigue and wear that does not suffer from the drawbacks of the prior art.

SUMMARY OF THE INVENTION

The present invention includes a method for surface treating a gas turbine engine component comprising a titanium or titanium alloy. The method includes providing a gas turbine engine component having a titanium-containing surface. The component is heated to a temperature sufficient to diffuse carbon into the titanium and below 1000° F. The surface is contacted with a carbon-containing gas to diffuse carbon into the surface to form carbides. Thereafter, the carbide-containing surface is coated with a lubricant comprising a binder and a friction modifier. The binder preferably including titanium oxide and the friction modifier preferably including tungsten disulfide. The coefficient of friction between the surface and another titanium-containing surface is less than about 0.6 in high altitude atmospheres.

In accordance with the present invention, a metallic surface comprising titanium is carburized, under controlled conditions, using carbon-containing gases, such as methane, propane, ethylene or acetylene gas or combinations thereof as the carburizing agent in order to form stable carbides at a controlled, preselected distance below the surface and/or absorb the carbon interstitially in the titanium matrix. The carbides formed in the surface harden the surface, providing a reduced coefficient of friction, and reducing fretting.

Another embodiment of the present invention includes a gas turbine engine component having a titanium-containing compressor disk. The compressor disk including a surface containing carbides and a lubricant coating thereon having a binder and a friction modifier. The binder preferably including titanium oxide and the friction modifier preferably including tungsten disulfide.

Another embodiment of the present invention includes a gas turbine engine component having a titanium-containing airfoil. The airfoil including one or more surfaces that contain carbides and a lubricant coating thereon. The lubricant coating includes a binder and a friction modifier. The binder preferably including titanium oxide and the friction modifier preferably including tungsten disulfide.

While the present invention contemplate the formation of titanium carbide, titanium alloys may include other carbide forming elements, such as, for example, vanadium. For example, alloys containing vanadium treated according to the present invention may include vanadium carbides, in addition to titanium carbides.

One advantage of the present invention is that the method according to the present invention decreases the susceptibility of the surface to fretting.

Another advantage of the present invention is that the method according to the present invention provides a hardened surface having carbides and/or interstitial carbon, which resist corrosion.

Another advantage of the present invention that the method according to the present invention provides a hardened surface that is resistance to erosion.

Another advantage of the present invention is that the carburization takes place at a low temperature, below 1000° F., which reduces the cost of equipment required to produce the carburized zone.

Another advantage of the present invention is that the surfaces subjected to fretting wear and fatigue may be replaced less often, decreasing servicing cost and reliability.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
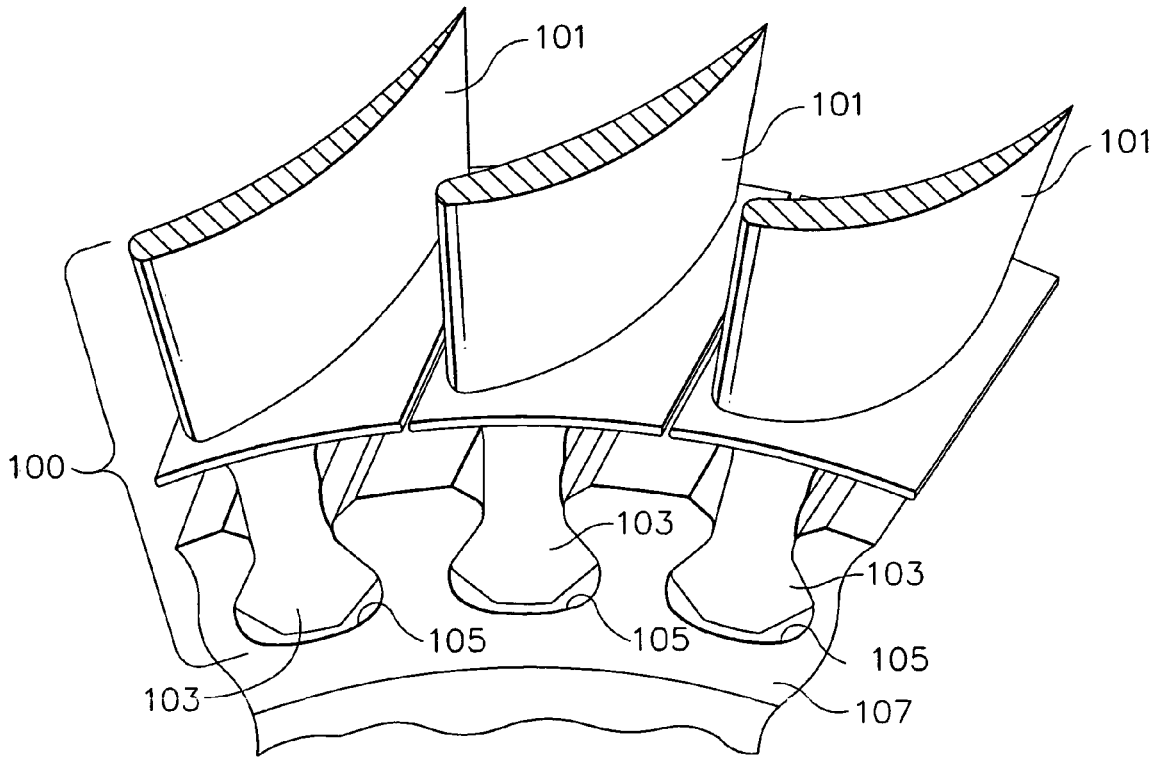
FIG. 1 is a cutaway view of a section of a known high-pressure compressor for a turbine engine according to the present invention

FIG. 1 is a cutaway view of a section of a high-pressure compressor for a turbine engine according to the present invention. The compressor includes a plurality of blades 100. The blades 100 include an airfoil 101 and a dovetail 103, which is positioned within dovetail slots 105 in a compressor disk 107. The dovetail 103 of the blade 100 retains the blade 100 during operation of the gas turbine engine. The blade 100 and the compressor disk 107 according to the invention include titanium and have one or more surfaces that are in frictional contact that are carburized to produce a surface having a carburized zone 401 (see FIGS. 4-9). In addition, one or more of the surfaces of the dovetail 103 and dovetails slots 105 of the compressor disk 107 are coated with a lubricant coating 601 (see FIGS. 6-9).

Figure 2:
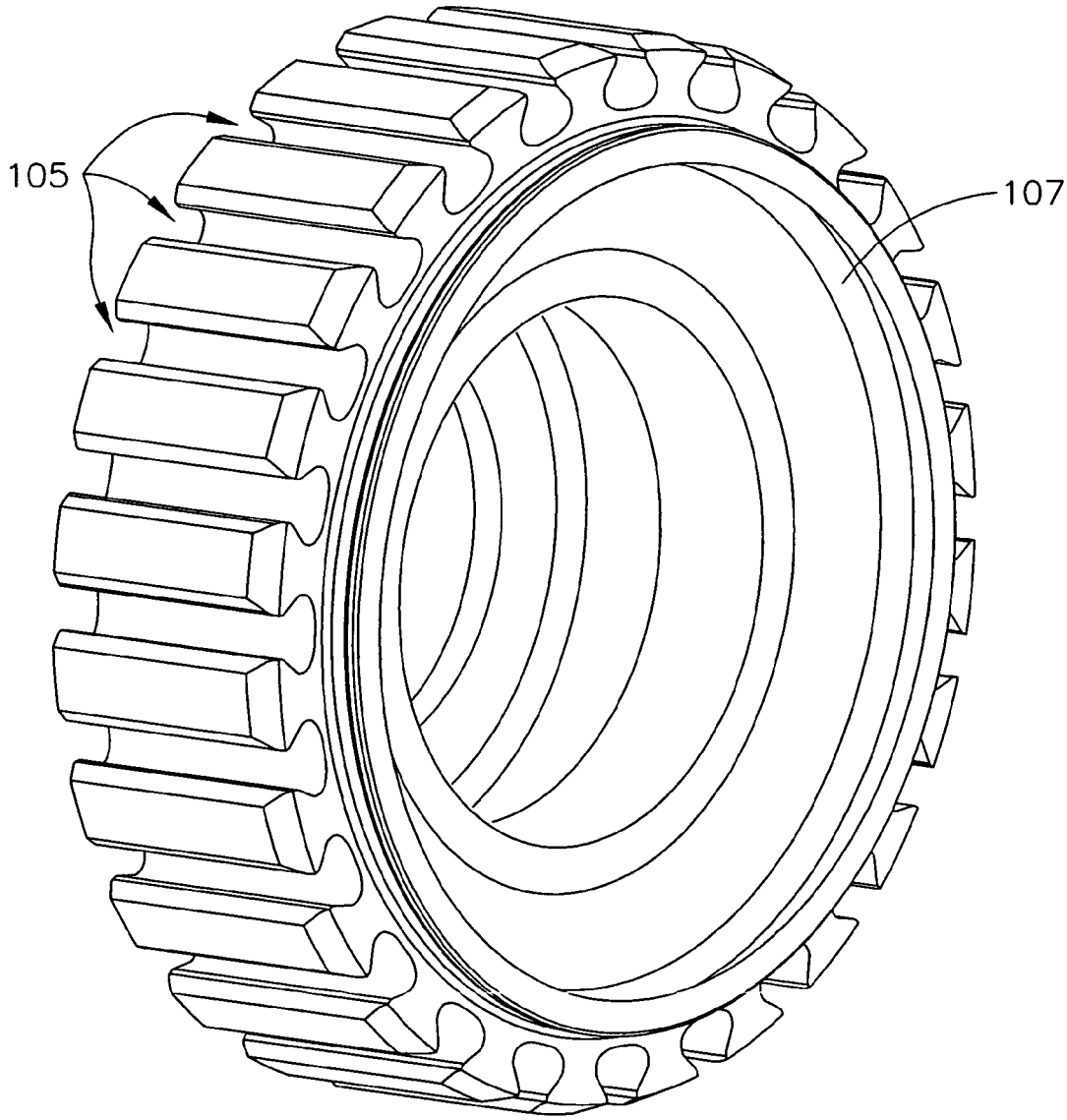
FIG. 2 shows a perspective view of a compressor disk according to an embodiment of the present invention.

FIG. 2 shows a perspective view of a compressor disk 107 according to an embodiment of the present invention, wherein FIG. 2 shows dovetail slots 105 into which the dovetail 103 section of blades 100 are positioned. The surfaces of dovetail slots 105 are subjected to sliding friction with dovetail 103 of blades 100 and are susceptible to fretting. The surface of compressor disk 107 includes a carburized zone 401 and, preferably, a lubricant coating 601 (see FIGS. 4-9).

Figure 3:
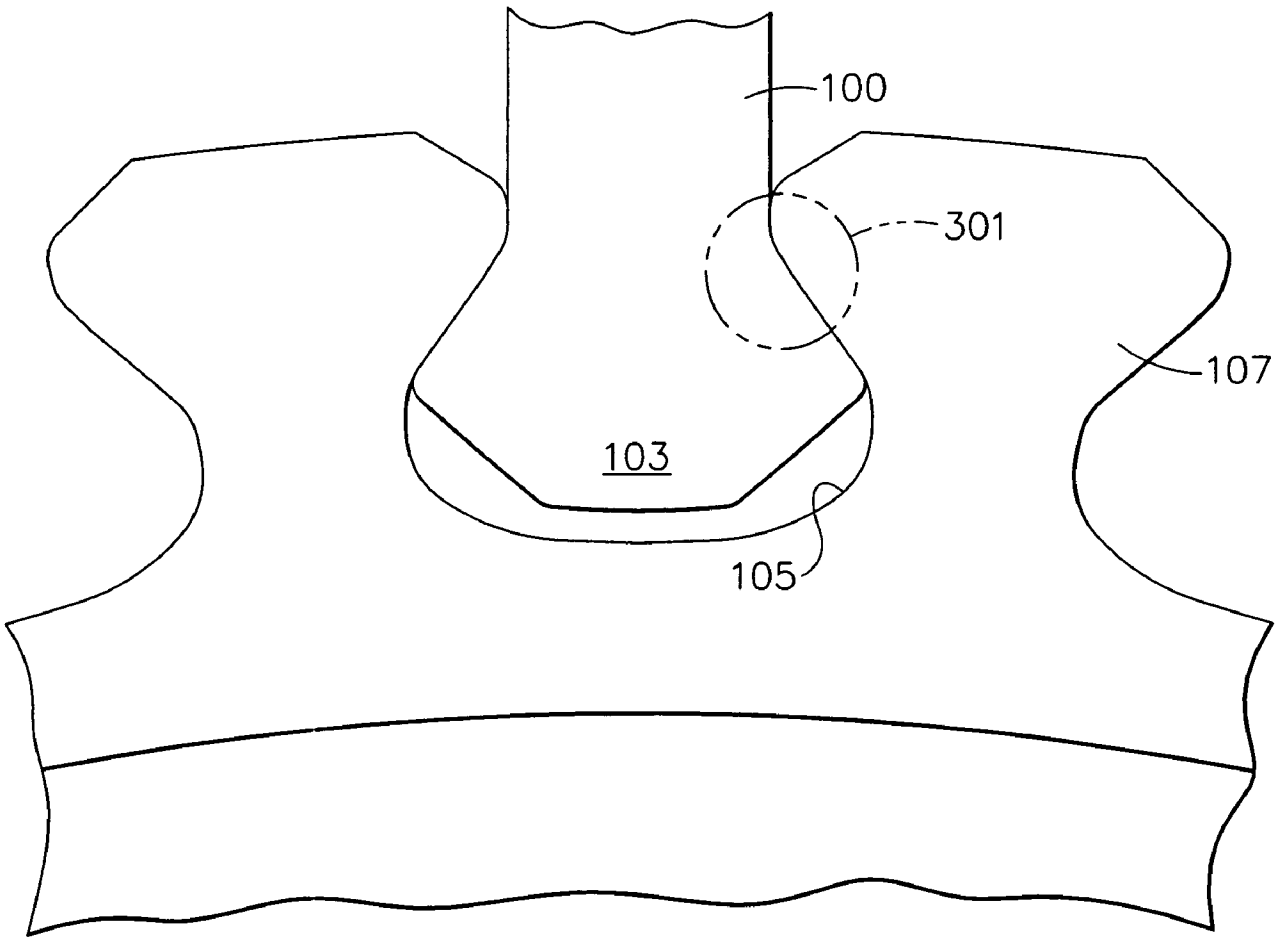
FIG. 3 shows a cutaway view of an airfoil dovetail positioned in a slot of a compressor disk according to the present invention.

FIG. 3 shows a cutaway view of a blade 100 positioned in dovetail slots 105 of compressor disk 107 according to an embodiment of the present invention. At least a portion of the surface of slot 105 is in frictional contact with at least a portion of the surface of dovetail 103. As the gas turbine engine operates, the centrifugal forces provided by the variation of the rotational speed of the compressor disk 107 results in rubbing between the surface of the dovetail 103 and the surface of the dovetail slot 105 in the compressor disk 107. The coefficient of friction between the surfaces of the dovetail 103 and the surface of the slot 105 are preferably maintained below 0.6. Preferably, the coefficient of friction is below 0.4. More preferably, the coefficient of friction is below 0.2. The lowering of the coefficient of friction is a result of the hardened surface resulting from the carburization. The carburized zone 401 (see FIGS. 4-9) has a greater hardness than an untreated titanium-containing surface. In addition, the application of a lubricant coating 601 (see FIGS. 6-9) further decreases the coefficient of friction. The additional lowering of the coefficient of friction is a result of the tribological properties of components of the lubricant coating 601.

FIGS. 4-9 shows enlarged cross-sections taken from region 301 from FIG. 3 illustrating alternate coating arrangements according to the present invention. The cross sections in FIGS. 4-9 each include a dovetail slot 105 of compressor disk 107 and dovetail 103 in frictional contact. The surface of the dovetail slot 105 of compressor disk 107 and the surface of the dovetail 103 form opposed surfaces onto which a carburized zone 401 and lubricant coating 601 may be applied. FIGS. 4-9 illustrate alternate locations for placement of the carburized zone 401 and lubricant coating 601. Lubricant coating 601 may be disposed on the dovetail 103, the dovetail slot 105 of the compressor disk 107, a carburized dovetail 103 or a carburized dovetail slot 105 of the compressor disk 107 or on a combination thereof. A preferred lubricant coating 601 includes, but is not limited to, tungsten sulfide, bismuth telluride or bismuth oxide in a binder of aluminum phosphate or titanium oxide. Although a space has been shown between the coatings on the compressor disk 107 and the dovetail 103 in FIGS. 4-9, the space is merely illustrative of the placement of the coatings. The coating systems on each of the surface of the dovetail slot 105 and the dovetail 103 are in frictional contact, wherein the surfaces are adjacent and experience sliding or rubbing. Also, FIGS. 4-9 are shown having thicknesses of the carburized zone 401 and lubricant coating 601 that is merely illustrative and does not indicate the relative thickness of the carburization coating 401 or the lubricant coating 601.

Figure 4:
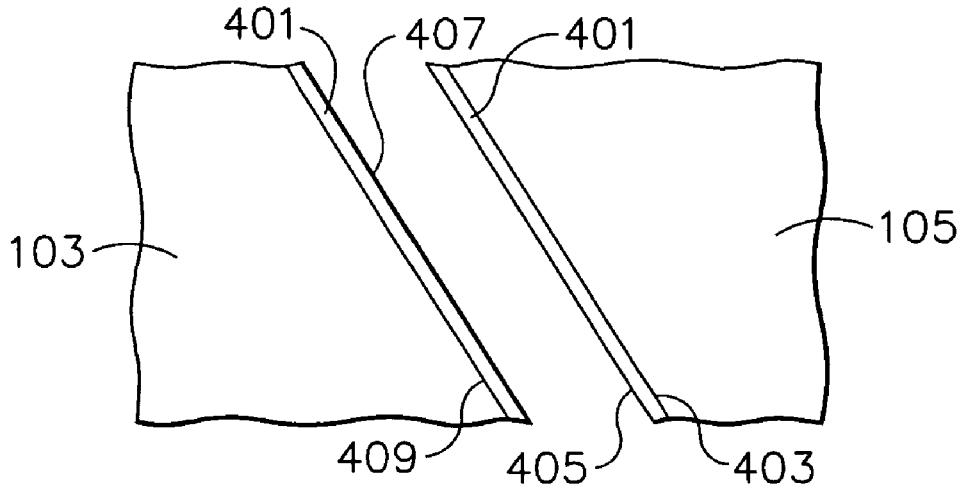
FIG. 4 shows an enlarged cross-sections taken from FIG. 3 showing an embodiment of the present invention.

FIG. 4 shows an enlarged cross-section taken from region 301 from FIG. 3 showing an embodiment of the present invention. FIG. 4 includes dovetail 103 interfacing with the dovetail slot 105 of compressor disk 107. Surface 403 of the dovetail slot 105 of compressor disk 107 and surface 409 of dovetail 103 have each been carburized and include carburized zone 401. Surface 405 includes the surface of the carburization coating 401 on the compressor disk and is in frictional contact with surface 407. Surface 407 is the surface of the carburized zone 401 on surface 409 of dovetail 103. The embodiment shown in FIG. 4 has the benefit that carburized zone 401 is provided on both the dovetail and compressor disk 107 providing hardened sliding surfaces that slide against each other providing desirable tribological properties. In particular, the combination of the hard, wear resistant carburized zone 401 sliding against each other provide a low coefficient of friction and increased fretting resistance.

Figure 5:
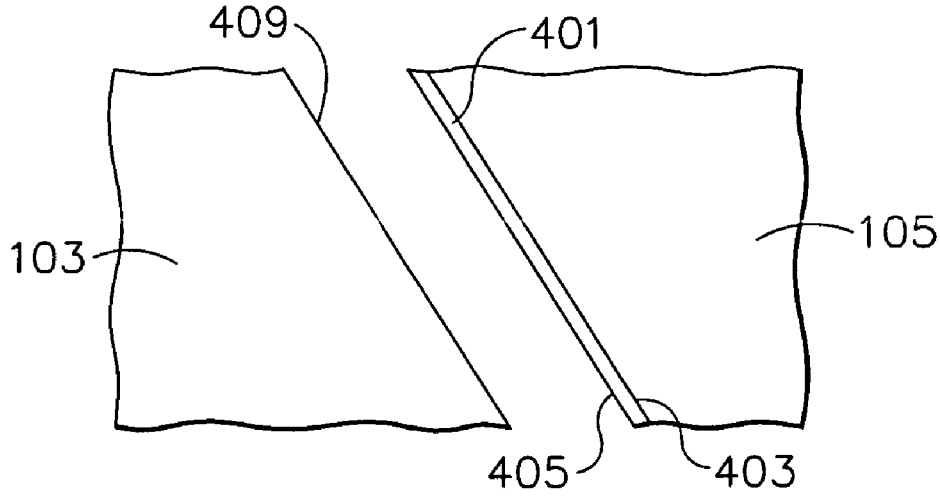
FIG. 5 shows an enlarged cross-sections taken from FIG. 3 showing an alternate embodiment of the present invention.

FIG. 5 shows an enlarged cross-section taken from region 301 from FIG. 3 showing an alternate embodiment of the present invention. FIG. 5 includes dovetail 103, dovetail slot 105 of compressor disk 107, as shown in FIG. 4. Surface 403 of the dovetail slot 105 of compressor disk 107 has been carburized and includes carburized zone 401. Surface 405 includes the surface of the carburized zone 401 on the dovetail slot 105 on compressor disk 107 and is in frictional contact with surface 409 of dovetail 103. The embodiment shown in FIG. 5 has the benefit that the carburized zone 401 is coated only on the compressor disk 107. Therefore, the application of carburized zone 401 requires less equipment and labor than applying carburized zone 401 to both the compressor disk 107 and the blade 100.

Figure 6:
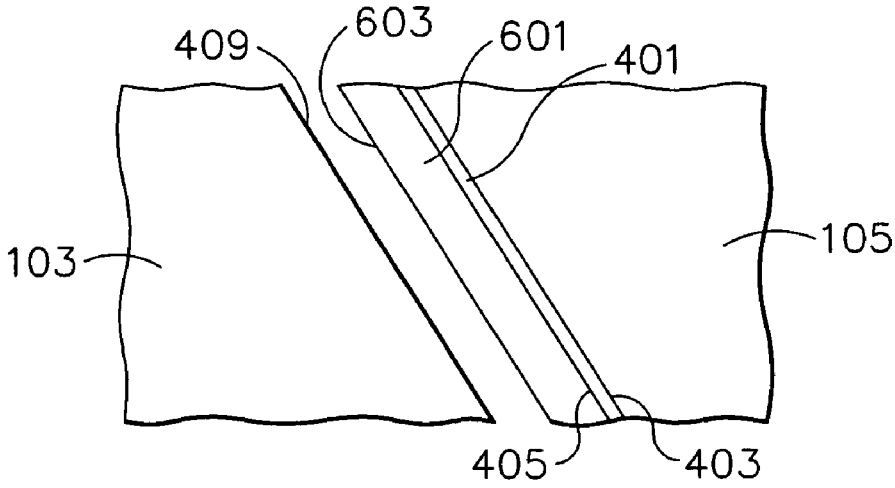
FIG. 6 shows an enlarged cross-sections taken from FIG. 3 showing an alternate embodiment of the present invention.

FIG. 6 shows an enlarged cross-section taken from region 301 from FIG. 3 showing an alternate embodiment of the present invention. FIG. 6 includes dovetail 103, dovetail slot 105 of compressor disk 107, as shown in FIG. 4. Surface 403 of the dovetail slot 105 of compressor disk 107 has been carburized and includes carburized zone 401. Lubricant coating 601 is disposed on surface 405 of the carburized zone 401. Surface 603 of lubricant coating 601 is in frictional contact with surface 409 of dovetail 103. The embodiment shown in FIG. 6 has the benefit that the carburized zone 401 and lubricant coating 601 are coated only on the compressor disk 107. Therefore, the production of carburized zone 401 requires less equipment and labor than producing carburized zone 401 to both the dovetail slot of compressor disk 107 and the airfoil. In addition, the compressor disk 101 is protected from fretting damage, whereas the cheaper airfoil 101 has not been specially treated. The carburized zone 401 and lubricant coating 601 provide protection of the compressor disk 107 and airfoil 101 system, while not adding expense to the blades 100.

Figure 7:
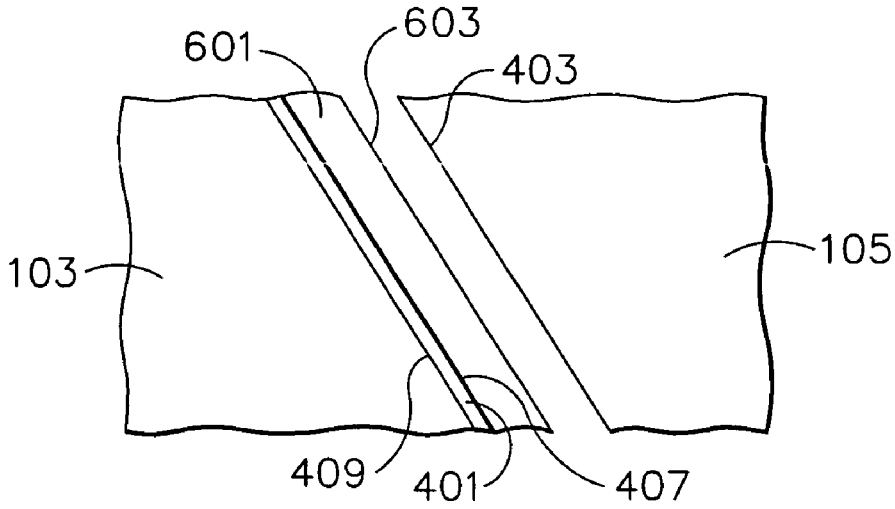
FIG. 7 shows an enlarged cross-sections taken from FIG. 3 showing an alternate embodiment of the present invention.

FIG. 7 shows an enlarged cross-section taken from region 301 from FIG. 3 showing an alternate embodiment of the present invention. FIG. 7 includes dovetail 103, dovetail slot 105 of compressor disk 107, as shown in FIG. 4. Surface 403 of dovetail 103 of blade 100 has been carburized and includes carburized zone 401. Lubricant coating 601 is disposed on surface 407 of the carburized zone 401. Surface 603 of lubricant coating 601 is in frictional contact with surface 403 of the dovetail slot 105 of compressor disk 107. The embodiment shown in FIG. 7 has the benefit that the carburized zone 401 and lubricant coating 601 are coated only on dovetail 103 of blade 100. Coating only the dovetail 103 has the advantage that the blades 100 may easily be removed from the compressor disk 107 in order to be coated according to the present invention. The compressor disk 107 and blade 100 system of the present invention may be retrofitted into existing gas turbine engines by removing the blades 100 from the compressor disks 107, wherein the removal of the compressor disk 107 from the engine is not necessary. In this embodiment, the dovetail 103 may provide the resistance to fretting without requiring the removal or replacement of the compressor disks 107 from the engine.

Figure 8:
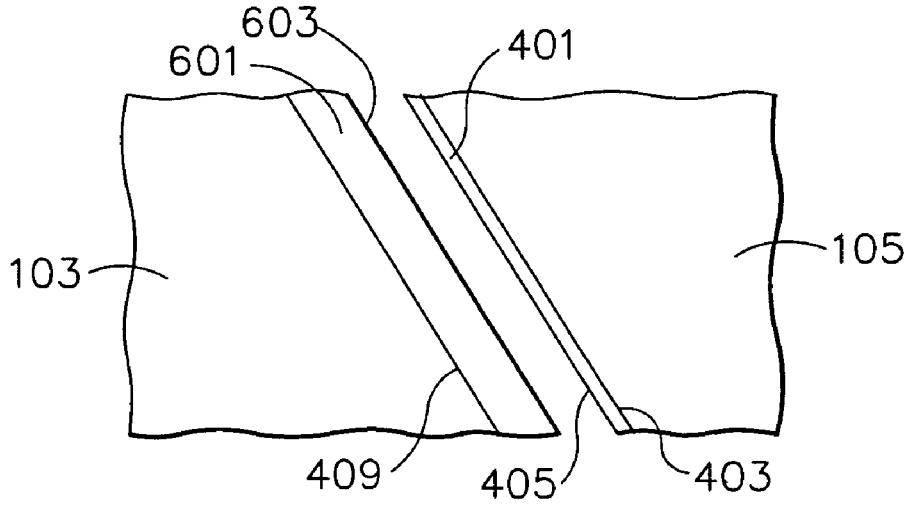
FIG. 8 shows an enlarged cross-section taken from FIG. 3 showing an alternate embodiment of the present invention.

FIG. 8 shows an enlarged cross-section taken from region 301 from FIG. 3 showing an alternate embodiment of the present invention. FIG. 8 includes dovetail 103, dovetail slot 105 of compressor disk 107, as shown in FIG. 4. Surface 403 of the dovetail slot 105 of compressor disk 107 has been carburized and includes carburized zone 401. Lubricant coating 601 is disposed on surface 409 of the dovetail 103. Surface 603 of lubricant coating 601 is in frictional contact with surface 405 of carburized zone 401 on the dovetail slot 105 of compressor disk 107. The embodiment shown in FIG. 8 has the benefit that the carburized zone 401 is present on the dovetail slot 105 of compressor disk 107 protecting the surface from fretting. In addition, the dovetail 103 of blade 100 is coated with lubricant coating 601. The lubricant coating 601 may be easily replaced by removing the blade 100 from compressor disk 107 and coating the lubricant coating 601 onto dovetail 103 of blade 100. The lubricant coating 601 in this embodiment permits the easy replacement of the lubricant coating 601 in the event that the lubricant coating 601 wears thin or wears completely off.

Figure 9:
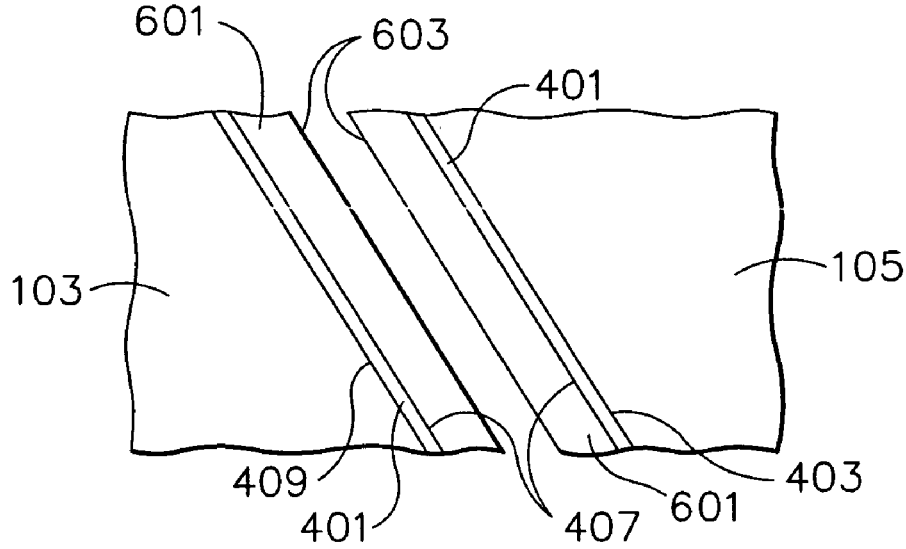
FIG. 9 shows an enlarged cross-section taken from FIG. 3 showing an alternate embodiment of the present invention.

FIG. 9 shows an enlarged cross-section taken from region 301 from FIG. 3 showing an alternate embodiment of the present invention. FIG. 9 includes dovetail 103, dovetail slot 105 of compressor disk 107, as shown in FIG. 4. Surface 403 of dovetail slot 105 of compressor disk 107 has been carburized and includes carburized zone 401. Surface 409 of dovetail 103 of blade 100 has also been carburized and includes carburized zone 401. Lubricant coating 601 is disposed on surface 407 of the carburized coatings 401, both on the dovetail 103 of blade 100 and on the dovetail slot 105 of compressor disk 107. Surface 603 of lubricant coating 601 on the carburized zone 401 on the dovetail slot 105 of compressor disk 107 is in frictional contact with surface 603 of lubricant coating 601 on the carburized zone 401 on the dovetail 103 of blade 100. The embodiment shown in FIG. 9 has the benefit that the carburized coating 401 and lubricant coating 601 are present on both the dovetail 103 of blade 100 and on the dovetail slot 105 on compressor disk 107, providing addition protection against fretting on both surfaces. In this embodiment, the coatings have additional protection against the lubricant coating 601 wearing off due to the two lubricant coatings 601. In addition, this embodiment permits the opposed hard, wear resistant carburized zone 401 surfaces to slide against each other provide a low coefficient of friction and increased fretting resistance with the addition fretting resistance provided by the lubricant coatings 601 disposed thereon.

The present invention also provides methods for carburizing a metallic surface comprising titanium. In a preferred embodiment, titanium-containing blade 100 or compressor disk 107 for use in a gas turbine engine is subjected to carburizing. The compressor disk 107 or airfoil according to the present invention is preferably a titanium alloy. In one embodiment of the invention, the compressor disk 107 or blade 100 is Ti-6-4 titanium alloy having about 6 wt % aluminum, about 4 wt % vanadium and balance essentially titanium. Other suitable alloys for use in the blade 100 include, but are not limited to Ti-4-4-2 (about 4 wt % aluminum, about 4 wt % molybdenum, and about 2 wt % tin), Ti-6-2-4-2 (about 6 wt % aluminum, about 2 wt % molybdenum, about 4 wt % zirconium and about 2 wt % tin), Ti-8-1-1 (about 8 wt % aluminum, about 1 wt % molybdenum, and about 1 wt % vanadium). Other suitable alloys for use in the compressor disk 107 include, but are not limited to Ti-17 (about 5 wt % aluminum, about 4 wt % chromium, about 4 wt % molybdenum, about 2 wt % zirconium and about 2 wt % tin) and Ti-6-2-4-2 (about 6 wt % aluminum, about 2 wt % molybdenum, about 4 wt % zirconium and about 2 wt % tin). Other suitable alloys for fabrication of compressor disk 107 for use with blades 100 having a carburized zone 401 include, but are not limited to, nickel-based alloys, such as INCONEL® 718, R-95, or R-88. INCONEL® is a federally registered trademark owned by Huntington Alloys Corporation of Huntington, W. Va. The composition of INCONEL® 718 is well-known in the art and is a designation for a nickel-based superalloy comprising about 18 weight percent chromium, about 19 weight percent iron, about 5 weight percent niobium+tantalum, about 3 weight percent molybdenum, about 0.9 weight percent titanium, about 0.5 weight percent aluminum, about 0.05 weight percent carbon, about 0.009 weight percent boron, a maximum of about 1 weight percent cobalt, a maximum of about 0.35 weight percent manganese, a maximum of about 0.35 weight percent silicon, a maximum of about 0.1 weight percent copper, and the balance nickel. R-95 includes a composition having about 8% cobalt, about 13% chromium, about 3.5% molybdenum, about 3.5% tungsten, about 3.5% aluminum, about 2.5% titanium, about 3.5% niobium, about 0.03% boron, about 0.03% carbon, about 0.03% zirconium, up to about 0.01% vanadium, up to about 0.3% hafnium, up to about 0.01% yttrium and the balance essentially nickel. R-88 includes a composition having about 13% cobalt, about 16% chromium, about 4% molybdenum, about 4% tungsten, about 2% aluminum, about 3.7% titanium, about 0.75% niobium, about 0.4% zirconium, about 0.06% carbon, about 0.010% boron and the balance essentially nickel.

In accordance with the present invention, a metallic surface comprising titanium is carburized, under controlled conditions, using carbon-containing gases, such as methane, propane, ethylene gas, acetylene, carbon dioxide, carbon monoxide or combinations thereof as the carburizing agent in order to form stable carbides at a controlled, preselected distance below the surface. The carbides may include titanium carbides, vanadium carbides and mixtures thereof, including titanium-vanadium carbide complexes. These gases may be mixed in combination, or non-reactive gases such as argon, helium, or hydrogen may be added in order to control the reactivity of the carburizing gases. The titanium carbide formed in the surface hardens the surface, providing a reduced coefficient of friction, and reducing fretting. The concentration and/or presence of interstitial carbon in the titanium matrix can also be a controlling factor in the process.

The present invention may include a step of cleaning the article surface. Cleaning the article surface entails removing a portion or substantially all oxides from the surface of the substrate and preventing the reformation of oxides from the surface that is to be carburized. The surface to be carburized is preferably free of oxides. Removing oxides can be accomplished by mechanical or chemical methods that do not damage or otherwise adversely affect the substrate surface. The mechanical or chemical oxide removal methods may be any oxide removal methods known in the art, including but not limited to grit blasting or chemical etching. After such cleaning, the surfaces may be cleaned with a suitable solvent, while avoiding the formation of oxides. While oxides are to be avoided, it may be desirable to mask portions of the surface in order to prevent these portions from being carburized. This may be desirable for any one of a number of reasons, such as titanium containing surfaces that are not in contact with other titanium containing surfaces and/or may not be susceptible to fretting or wear. Therefore, when desirable, the portion that does not require carburized may be masked.

Although masking may be provided to surface portions of the compressor disk 107 and/or the blade 100, the carburizing of the entire compressor disk 107 and/or blade 100 may provide the compressor disk 107 and blade 100 with desirable surface properties. For example, an airfoil 101 portion of a blade 100 having a carburized zone 401 may be resistant to corrosion due to the presence of carbides and/or interstitial carbon at the surface. The resistance to corrosion is desirable for airfoils 101 and compressor disks 107 due to the fact that the airfoils 101 and compressor disks may contact air that includes water and/or corrosion accelerators, such as salt. In addition, the carburizing of the entire compressor disk 107 and/or blade 100 may provide the compressor disk 107 and blade 100 with protection against erosion due to the hardened, wear-resistant carburized zone 401. The resistance to erosion is desirable, for example, for airfoils 101 and compressor disks 107 due to contact with air that includes abrasive material, such as sand or dirt. Therefore, the method of the present invention may advantageously be utilized to coat the entire compressor disk 107 and/or blade 100.

The cleaned article is then loaded into a furnace suitable for performing the carburization process. Suitable furnaces include vacuum furnaces or furnaces that can maintain a controlled atmosphere. The furnace is heated to a temperature sufficient to permit the diffusion of carbon into titanium, and less than about 1000° F. (538° C.). preferably, the furnace is heated to about 750° F. (400° C.). After the titanium-containing article has reached the carburization temperature, the carburizing gases may be introduced into the furnace by any method that prevents the introduction of oxygen. In addition, introduction of the carburizing gases should be such that the concentration of the carbon-containing gas may be varied. When maintaining a controlled atmosphere, the atmosphere must be non-oxidizing, as oxidation of the article surface and reaction of the carburizing gas with oxygen must be prevented during heat-up to the carburizing temperature and during carburizing. Once the carburizing temperature is approached, the carburizing gas, methane, propane, ethylene or acetylene, is introduced into the furnace. These carburizing gases may be introduced below the carburizing temperature with hydrogen or to gradually replace hydrogen, but should not be added at temperature or in a volume that will result in excessive soot formation. The carburizing gas is provided to ensure sufficient carbon is present at the article surface for desired carburization so that carbides are formed in a layer of sufficient thickness to form titanium carbide and/or to allow for carbon to be absorbed interstitially, to increase the hardness of the surface and to reduce fretting. The formation of the carbides during the carburization results in a hardening of the surface. As the hardness of the surface increases, the incident of localized adhesion between titanium-containing surfaces is reduced. The reduction is localized adhesion results in a greater resistance to fretting fatigue and wear. The duration, temperature and concentration of carbon in the carbon-containing gas of the carburization process may be controlled to limit the depth of carbide layer formation.

Carburization is continued until the desired carburization depth is reached at which time the operation is stopped by introducing an inert gas to the furnace. Carburization ceases when the surface temperature of the article is less than the temperature at which carbon diffuses. The depth of the carburization varies based upon a variety of factors including the time the article is exposed to the carbon-containing gas, the concentration of the carbon in the carbon-containing gas and the temperature of the article. A preferable depth for the carburization coating 401 is up to about 0.01 inches. More preferably up to about 0.001 inches. The carburization process according to the invention takes place for a time up to about 1500 hours for the desired carburization coating 401 depth to be achieved. Preferably, the carburization takes place for a time up to about 1000 hours.

The carburization process is completed by purging the chamber of the carburizing gas. This can be accomplished by stopping the flow of the carburizing gas and introducing an inert gas, nitrogen or hydrogen into the chamber. This also serves to cool the article. Any masking present on the surface may be removed.

As will be recognized by those skilled in the art, several operating parameters can be varied, therefore these parameters must be controlled to control the desired carbide layer thickness. These parameters include, but are not limited to gas flow rate, which determines partial gas pressure, temperature, type of furnace, working zone size, work load and time.

After processing and cooling, the work load, may comprise a plurality of articles, can be removed from the work zone. Any optional masking may be removed before or after the application of the lubricant coating 601. Masking may be removed by any suitable means that does not adversely affect the substrate surface, such as chemical stripping, mechanical means such as blasting, or other known methods consistent with the masking material.

Compressor disks 107 and airfoils 101 that comprise titanium are particularly suitable for use with the method of the present invention. Carburized compressor disks 107 and/or dovetails 103 coated with a lubricant coating 601 provide desirable tribological properties. The present invention utilizes the combination of the relatively hard carburized zone 401 in combination with a relatively soft, lubricious lubricant coating 601, which may be placed on surfaces susceptible to wear. Suitable surfaces include component surfaces within a compressor of a gas turbine engine. The carburized zone 401 reduces the coefficient of friction between the compressor disk 107 and blade 100. The lubricant coating 601 further reduces the coefficient of friction between the compressor disk 107 and the blade 100, reducing localized adhesion between the surfaces, thereby reducing fretting.

The coefficient of friction is preferably maintained in the wear system of the dovetail slot 105 and dovetail 103 equal to or less than 0.6 and preferably equal or less than 0.4. More preferably, the coefficient of friction is maintained in the wear system of the dovetail slot 105 and dovetail 103 equal to or less than 0.2. The coefficient of friction is measured between the two surfaces rubbing against each other. In the embodiments of the present invention shown in FIGS. 4-9, the coefficient of friction between the dovetail 103 of blade 100 and dovetail slot 105 of compressor disk 107, is less than or equal to about 0.6. The compressor disk 107 and blade 100 may be fabricated from any suitable material, including but not limited to metals and metal alloys. Preferred materials include titanium and its alloys. Other suitable alloys include, but are not limited to, nickel-based alloys, such as INCONEL® 718. In addition, compressor disks 107 may be fabricated from nickel-based alloys, such as R-95 and R-88.

The lubricant coating 601 comprises a binder, a friction modifying agent, and, optionally, an additive. The binder of the lubricant coating 601 comprises a material selected from the group consisting of sodium silicate, aluminum phosphate, titanium oxide and combinations thereof. The friction-modifying agent is preferably dispersed substantially uniformly through the binder. The lubricant coating 601 reduces the coefficient of friction between the dovetail slot 105 of compressor disk 107 and the dovetail 103 of blade 100. Of the antifriction coating binders, aluminum phosphate and titanium oxide are preferred. As the gas turbine engine and the compressor operate, lubricant coating 601 may eventually be consumed due to the sliding of the surfaces. The lubricant coating 601 is resilient and regenerates in areas where the coating is rubbed thin or cleaned off the wear surface. The lubricant coating 601 is thin when the thickness on a portion of the surface is insufficient to provide sufficient lubricity to the sliding surfaces to maintain the coefficient of friction at the desired level. In addition, during operation, the lubricant coating 601 may migrate from location to location along the sliding surfaces. The migration of the lubricant coating 601 allows areas that have less material or are rubbed completely off to receive lubricant coating material from other locations along the wear surface to regenerate the coating missing from the area rubbed thin or completely off.

The binder material for use in the lubricant coating 601 is any binder material that is tribologically compatible with all of the following materials: 1) water, 2) detergents used in the cleaning of gas turbine engine parts, 3) deicers known in the art used to deice aircraft in winter, 4) aircraft fuel, 5) oil and 6) hydraulic fluid. The materials are tribologically compatible if the binder in the lubricant coating 601 maintains tribological properties (e.g., lubricity and wear resistance) of the lubricant coating 601 when in contact with the surfaces subjected to sliding friction and in contact with the materials listed above. In order to maintain tribological properties, the binder exhibits the ability to remain coated on the substrate, does not result in separation of the friction modifier and the binder, and does not result in substantial softening of the antifriction coating. Suitable binder materials include, but are not limited to, sodium silicate, aluminum phosphate, titanium oxide and combinations thereof. Binders that provide the highest tribological compatibility include titanium oxide and aluminum phosphate.

The friction modifier is any material that, when added to the binder, produces a friction coefficient suitable for maintaining desirable tribological properties within the compressor of a gas turbine engine. In addition to reducing the amount of fretting that takes place between the dovetail 103 of the airfoil 101 and the compressor disk 107, the lubricant coating 601 ideally should withstand the operating conditions of the compressor, including high altitude atmosphere, including atmospheres devoid of water vapor, and high temperatures. The high altitude atmospheres include atmospheres to which aircraft are exposed during flight. The high altitude atmosphere includes atmospheres having reduced or no water vapor, which causes lubricants containing graphite to lose their effectiveness as a lubricant. High temperature exposure is a result of the operation of the gas turbine engine. The compression of the gas and the combustion of the fuel result in high temperatures in gas turbine engines. Parts within the gas turbine engine, including the components of the compressor, may be subject to high temperatures. The coating system, including the carburized zone 401 and lubricant coating 601 of the present invention may find uses in parts within the gas turbine engine that are exposed to temperatures up to and in excess of about 800° F. Desirable tribological properties include, but are not limited to low coefficient of friction between sliding surfaces (i.e., high lubricity) and low wear between sliding surfaces. Preferred friction modifier materials include, but are not limited to, tungsten sulfide (e.g., $WS_2$), bismuth telluride (e.g., $Bi_2Te_3$), copper sulfide (e.g., $Cu_2S$), bismuth oxide (e.g., $Bi_2O_3$) and combinations thereof. Of the friction modifiers, tungsten sulfide (e.g., $WS_2$), bismuth telluride (e.g., $Bi_2Te_3$) and bismuth oxide (e.g., $Bi_2O_3$) are preferred.

The presence of the combination of the lubricant coating 601 and the carburized zone 401 permits the operation of the compressor having reduced fretting even is systems that do not have the most preferred friction modifier. For example, in less preferred lubricant coating systems, such as a system containing graphite on top of the carburized zone 401, the carburized zone 401 maintains a lower coefficient of friction even in the absence of water vapor, due to the hardened surface. Therefore, the lubricant coating 601 and carburized zone 401 combination may provide reduced fretting even in systems having lubricant coating 601 that do not perform well in atmospheres devoid of water vapor.

Table 1 shows examples of lubricant coating materials according to the present invention. The examples shown are merely examples and do not limit the invention to the combinations of binders and friction modifiers shown therein. Examples 1-5, shown in Table 1, include coefficient of friction (COF) results for particular friction modifier and binder combinations. In order to determine the coefficient of friction, the lubricant coating materials are subject to a sliding wear test as known in the art. The tests were conducted with a reciprocating stroke length of 0.060 inches. Lubricant coating material (i.e., inert material, binder and friction modifier) were loaded onto the wear surfaces and dried to form an antifriction coating 601. The coated wear surfaces were then subject to a load of 50 lbs. and reciprocation motion. The coefficients of friction were measured at various temperatures during the test and an average coefficient (i.e., Avg COF) of friction was calculated as the coefficient of friction for the wear system. Table 1 shows the an average coefficient of friction for each example having the average coefficient of friction resulting from tests run at various friction modifier to binder loadings. The lubricant coating 601 was formed from drying a composition on the test surface having a binder loading of 10% by weight and friction modifier loadings of from 15% by weight to 25%, corresponding to friction modifier to binder weight ratios of from 1.5:1 to about 2.5:1. The balance of the composition is of essentially inert material that is removed during drying.

TABLE 1

| Ex. | Binder 10% | Friction Modifier 15/20/25% | COF Initial | COF room temp. | COF at 400° F. | COF at 750° F. | Avg COF |
|---|---|---|---|---|---|---|---|
| 1 | titanium oxide | tungsten sulfide | 0.2 | 0.5 | 0.4 | 0.6 | 0.43 |
| 2 | titanium oxide | bismuth telluride | 0.3 | 0.7 | 0.7 | 0.6 | 0.58 |
| 3 | titanium oxide | bismuth oxide | 0.2 | 0.7 | 0.7 | 0.6 | 0.55 |
| 4 | titanium oxide | copper sulfide | 0.3 | 0.6 | 0.7 | 0.6 | 0.55 |
| 5 | aluminum phosphate | tungsten sulfide | 0.3 | 0.4 | 0.5 | 0.5 | 0.43 |

The friction modifier is preferably incorporated into lubricant coating 601 in a quantity of about 10% to about 500% by weight of binder. More preferably, the friction modifier is incorporated into the lubricant coating 601 from 100% to about 350% by weight of binder. The friction modifier is incorporated into the binder material and is preferably encapsulated in the binder material. Encapsulation may take place using any suitable encapsulation method, including but not limited to powder metallurgical encapsulation methods. The lubricant coating 601 including the binder and friction modifier is coated onto the surfaces subject to wear (i.e., wear surface). Suitable methods for coating include, but are not limited to, spraying or dipping the surface to be coated with a lubricant coating 601 and subsequently drying the lubricant coating 601, removing at least some of the inert material present. The dried surface forms a lubricant coating 601 that is tenacious and substantially uniform across the wear surface. Optionally, the lubricant coating 601 may be heated during the drying step. Table 2 shows the average coefficient of friction and wear in inches for various friction modifier loadings in the lubricant coating composition. In addition, Table 2 shows the average number of sliding cycles (i.e. reciprocations) used in Examples 6-11 at room temperature, 400° F. (204° C.), and 750° F. (399° C.), which resulted in the average wear shown.

TABLE 2

| Ex. | Binder (10% Loading) | Friction Modifier | Friction Modifier Loading (%) | Friction Modifier to Binder Weight Ratio | Avg COF | Average Wear (inches) | Average Sliding Cycles |
|---|---|---|---|---|---|---|---|
| 6 | titanium oxide | tungsten sulfide | 25 | 2.5:1 | 0.47 | 0.001-0005 | 575,000 |
| 7 | titanium oxide | tungsten sulfide | 30 | 3.0:1 | 0.59 | 0.001-0.005 | 600,000 |
| 8 | titanium oxide | tungsten sulfide | 35 | 3.5:1 | 0.40 | 0.001-0.005 | 625,000 |
| 9 | titanium oxide | bismuth telluride | 25 | 2.5:1 | 0.59 | 0.001-0.004 | 350,000 |
| 10 | titanium oxide | bismuth telluride | 30 | 3.0:1 | 0.54 | 0.001-0.004 | 362,500 |
| 11 | titanium oxide | bismuth telluride | 35 | 3.5:1 | 0.55 | 0.001-0.004 | 312,500 |

Although the average shown in Table 2 range from 350,000 to 635,000 cycles, in each of Examples 6-11, 1,000,000 sliding cycles were made at 750° F. (399° C.).

The dovetail slot 105 and dovetail 103 system of the present invention with the carburized zone 401 and lubricant coating 601 combination on one or both of the opposed surfaces, is preferably resistant to wear over the entire operating temperature range of the gas turbine engine compressor. In one embodiment of the present invention, the opposed surfaces wear less than about 0.005 inches after at least 500,000 reciprocations (i.e., cycles). In another embodiment, the carburized zone 401 and lubricant coating 601 combination according to the present invention results in wear to the vane assembly of less than about 0.005 inches over 2 million reciprocations (i.e., cycles) at temperatures up to about 800° F., where each cycle or reciprocation comprises one movement in the reciprocating back and forth motion.

The dovetail slot 105 and dovetail 103 combination preferably maintains a friction coefficient between the sliding surfaces at or below about 0.6 over the entire operating range of the compressor. More preferably, the dovetail slot 105 and dovetail 103 combination of the present invention maintains a friction coefficient between the sliding surfaces of below about 0.5. In particular, the surface of compressor disk 107 in contact with blade 100 of the present invention preferably maintains a coefficient of friction of less than about 0.5 when in contact with the blade 100 in a reciprocating motion under a load at temperatures up to 800° F. (427° C.).

In another embodiment of the present invention, additives may be included in the lubricant coating 601 to provide additional desirable properties for the coating system. The additional additive is an additive that provides desirable properties, such as increased lubricity, increased adhesion of the lubricant coating 601 to the surface, or increased coating uniformity, to the composition. Suitable additional additives include, but are not limited to, polytetrafluoroethylene, adhesion promoters, dispersing agents and combinations thereof. Examples of additional additives include graphite, molybdenum sulfide, molybdenum diselenide and copper.

Alternate systems that find use with the present invention include titanium-containing components of the gas turbine engine, including actuator mechanisms, dovetail surfaces elsewhere in the engine and other surfaces where a low coefficient of friction is required or desirable. In particular, the present invention finds use in applications susceptible to fretting, including applications where one titanium-containing surface slides against a second titanium-containing surface. Treatment of one or both of the surfaces in frictional contact reduces the coefficient of friction, while also reducing fretting fatigue and wear.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for surface treating a titanium gas turbine engine component comprising:

providing a gas turbine engine component having a surface comprising titanium;

heating the component to a temperature sufficient to diffuse carbon into the titanium and below 1000° F. or;

contacting the surface with a carbon-containing gas for a period of time sufficient to diffuse carbon into the surface and provide interstitial carbon in the titanium matrix;

coating the carbide-containing surface with a lubricant coating comprising a binder and a friction modifier; and wherein the coefficient of friction between the surface and another titanium-containing surface is less than about 0.6 in an atmosphere substantially devoid of water vapor.

2. The method of claim 1, wherein the surface comprises a titanium-containing alloy selected from the group consisting of Ti-6-4, Ti-17, Ti-4-4-2, Ti-6-2-4-2, Ti-8-1-1 and titanium-containing nickel-based superalloys.

3. The method of claim 1, wherein the friction modifier comprises a material selected from the group consisting of tungsten sulfide, bismuth telluride, bismuth oxide and combinations thereof.

4. The method of claim 3, wherein the friction modifier comprises tungsten sulfide.

5. The method of claim 1, wherein the binder comprises a material selected from the group consisting of titanium oxide, aluminum phosphate and combinations thereof.

6. The method of claim 5, wherein the binder comprises titanium oxide.

7. The method of claim 1, wherein the coefficient of friction between the surface and another titanium-containing surface is less than about 0.4 in the atmosphere substantially devoid of water vapor.

8. The method of claim 7, wherein the coefficient of friction between the surface and another titanium-containing surface is less than about 0.2 in the atmospheres substantially devoid of water vapor.

9. The method of claim 1, wherein the high altitude atmospheres include up to about 800° F.

* * * * *